US008295730B2

(12) United States Patent
Iikura

(10) Patent No.: US 8,295,730 B2
(45) Date of Patent: Oct. 23, 2012

(54) IMAGE FORMING APPARATUS HAVING AN IMAGE FORMING PART AND A DETACHABLE DEVELOPER RECOVERY CONTAINER

(75) Inventor: Kazuaki Iikura, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 433 days.

(21) Appl. No.: 12/617,157

(22) Filed: Nov. 12, 2009

(65) Prior Publication Data

US 2010/0215398 A1 Aug. 26, 2010

(30) Foreign Application Priority Data

Feb. 20, 2009 (JP) ..... 2009-037514

(51) Int. Cl.
*G03G 21/18* (2006.01)

(52) U.S. Cl. ..... 399/111

(58) Field of Classification Search ..... 399/111, 399/113, 120, 257, 358, 360
See application file for complete search history.

(56) References Cited

U.S. PATENT DOCUMENTS

| | | | | |
|---|---|---|---|---|
| 7,155,148 | B2 * | 12/2006 | Nishimura et al. | 399/257 |
| 7,995,955 | B2 * | 8/2011 | Izumi et al. | 399/257 |
| 8,000,628 | B2 * | 8/2011 | Sato et al. | 399/360 |
| 8,116,662 | B2 * | 2/2012 | Ohta | 399/120 |

FOREIGN PATENT DOCUMENTS

| | | |
|---|---|---|
| JP | 11-003015 | 1/1999 |
| JP | 2000-321872 | 11/2000 |
| JP | 2004-198789 | 7/2004 |
| JP | 2006-195492 | 7/2006 |
| JP | 2007-102065 | 4/2007 |
| JP | 2008-134381 | 6/2008 |

* cited by examiner

*Primary Examiner* — William J Royer
(74) *Attorney, Agent, or Firm* — Morgan, Lewis & Bockius LLP

(57) ABSTRACT

An image forming apparatus includes: an image forming apparatus main body; plural developer image forming parts provided in the image forming apparatus main body that form a developer image; and a discharged developer recovery container that recovers developer discharged from at least two of the plural developer image forming parts. At least one of the plural developer image forming parts has an image forming structure having an image holder that holds the developer image, and the image forming structure in the at least one developer image forming part and the discharged developer recovery container are attached/removed, integrally with each other, in/from the image forming apparatus main body.

13 Claims, 9 Drawing Sheets

IMAGE FORMING APPARATUS HAVING AN IMAGE FORMING PART AND A DETACHABLE DEVELOPER RECOVERY CONTAINER

CROSS-REFERENCE TO RELATED APPLICATIONS

This application is based on and claims priority under 35 USC 119 from Japanese Patent Application No. 2009-037514 filed Feb. 20, 2009.

BACKGROUND

Technical Field

The present invention relates to an image forming apparatus, an image forming structure, and a developer recovery container.

SUMMARY

According to an aspect of the present invention, there is provided an image forming apparatus including: an image forming apparatus main body; plural developer image forming parts provided in the image forming apparatus main body that form a developer image; and a discharged developer recovery container that recovers developer discharged from at least two of the plural developer image forming parts, at least one of the plural developer image forming parts having an image forming structure having an image holder that holds the developer image, and the image forming structure in the at least one developer image forming part and the discharged developer recovery container being attached/removed, integrally with each other, in/from the image forming apparatus main body.

BRIEF DESCRIPTION OF THE DRAWINGS

An exemplary embodiment of the present invention will be described in detail based on the following figures, wherein.

DETAILED DESCRIPTION

Next, an exemplary embodiment of the present invention will be described based on the drawings.

Figure 1:
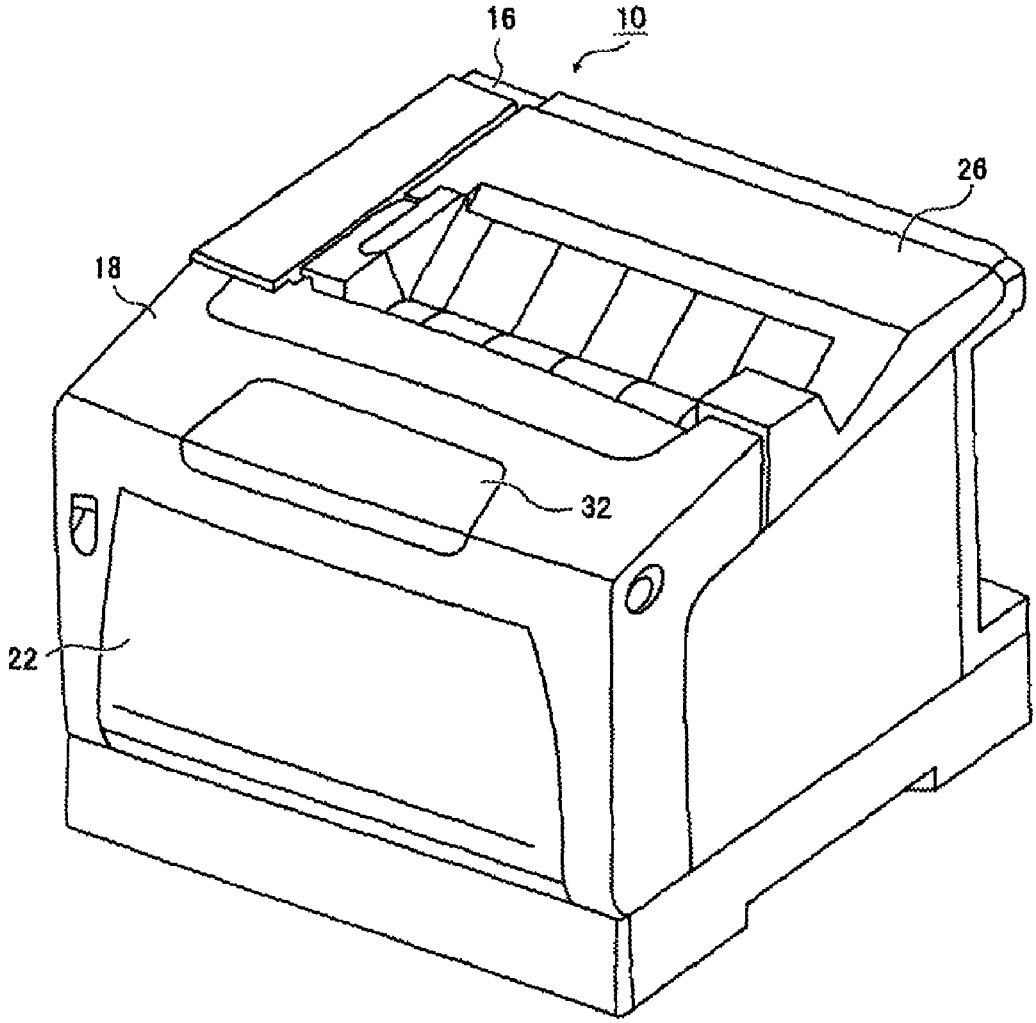
FIG. 1 is a perspective diagram showing an image forming apparatus according to an exemplary embodiment of the present invention.
Figure 2:
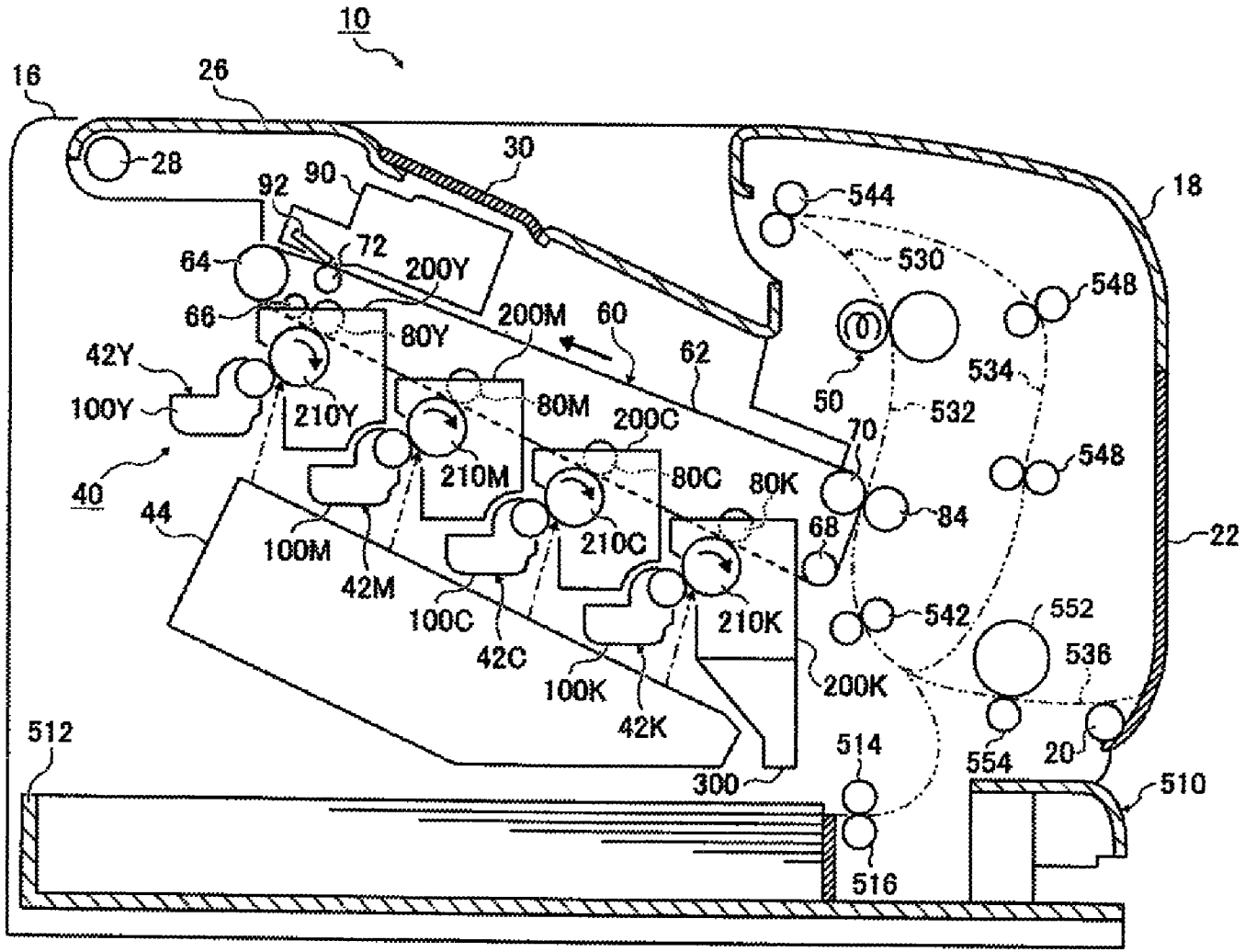
FIG. 2 is a cross-sectional diagram showing the image forming apparatus shown in FIG. 1.

FIGS. 1 and 2 show an image forming apparatus 10 according to the exemplary embodiment of the present invention. As shown in FIGS. 1 and 2, the image forming apparatus 10 has an image forming apparatus main body 16.

A front opening/closing part 18 is attached to the image forming apparatus main body 16 using a hinge 20 openably/closably with respect to the image forming apparatus main body 16. Further, a main opening/closing part 26 is attached to the image forming apparatus main body 16 using a hinge 28 openably/closably with respect to the image forming apparatus main body 16. Further, an operation part 32 is attached to a front side of the image forming apparatus main body 16.

A supply opening/closing part 22 is openably/closably attached to the front opening/closing part 18. As shown in FIGS. 1 and 2, the supply opening/closing part 22 is usually closed with respect to the front opening/closing part 18. When a recording sheet different from a recording sheet contained in a recording sheet supply device 510 to be described later is used, the supply opening/closing part 22 is opened with respect to the front opening/closing part 18. Note that the recording sheet means a medium such as a normal paper sheet or an OHP sheet on which an image formation is finally performed.

The main opening/closing part 26 is usually closed with respect to the image forming apparatus main body 16. When one of photoreceptor units 200Y, 200M, 200C and 200B and a developer recovery container 300, to be described later, is attached/removed in/from the image forming apparatus main body 16, the main opening/closing part 26 is opened. The front opening/closing part 18 is opened with respect to the image forming apparatus main body 16 prior to opening of the main opening/closing part 26 so as to prevent a support roller 70, an intermediate transfer belt 62 to be described later and the like attached to the main opening/closing part 26, from interfering with the front opening/closing part 18.

When the front opening/closing part 18 is closed with respect to the image forming apparatus main body 16, prior to closing of the front opening/closing part 18, the main opening/closing part 26 is closed with respect to the image forming apparatus main body 16. An upper side surface of the main opening/closing part 26 is used as a discharge part to which a recording sheet on which an image is formed is discharged.

A sub opening/closing part 30 is attached to the main opening/closing part 26 openably/closably with respect to the main opening/closing part 26. The sub opening/closing part 30 can be opened/closed independently of the main opening/closing part 26, and the sub opening/closing part 30 can be opened with respect to the main opening/closing part 26 in a state where the main opening/closing part 26 is closed with respect to the image forming apparatus main body 16. The sub opening/closing part 30 is opened when the entire or part of a cleaning device 90 to be described later is attached/removed in/from the image forming apparatus main body 16.

The operation part 32 has ten keys to input e.g. the number of recording sheets used for image formation, a start key operated to start image formation, and the like.

An image forming part 40 to form an image on a recording sheet is provided in the image forming apparatus main body 16. The image forming part 40 has e.g. four developer image forming parts 42Y, 42M, 42C and 42K, an optical writing device 44, and a transfer device 60. The developer image forming part 42Y forms a developer image using yellow developer. The developer image forming part 42M forms a developer image using magenta developer. The developer image forming part 42C forms a developer image using cyan developer. The developer image forming part 42K forms a developer image using black developer. Note that in the following description, the developer image forming parts 42Y, 42M, 42C and 42K will be generically named a developer image forming part 42.

The developer image forming parts 42Y, 42M, 42C and 42K have photoreceptor units 200Y, 200M, 200C and 200K and developing devices 100Y, 100M, 100C and 100K.

The photoreceptor units 200Y, 200M, 200C and 200K which are respectively used as an image forming structure have photoreceptor drums 210Y, 210M, 210C and 210K. The photoreceptor units 200Y, 200M, 200C and 200K are arrayed in this order sequentially from the rear side of the image forming apparatus main body 16 (left side in FIG. 2). The details of the photoreceptor units 200Y, 200M, 200C and 200K will be described later.

The photoreceptor drums 210Y, 210M, 210C and 210K are respectively used as an image holder.

Further, the developer image forming parts 42Y, 42M, 42C and 42K have the developing devices 100Y, 100M, 100C and 100K. The developing device 100Y develops a latent image formed on the photoreceptor drum 210Y using yellow toner contained in the developing device 100Y. The developing device 100M develops a latent image formed on the photoreceptor drum 210M using magenta toner contained in the developing device 100M. The developing device 100C develops a latent image formed on the photoreceptor drum 210C using cyan toner contained in the developing device 100C. The developing device 100K develops a latent image formed on the photoreceptor drum 210K using black toner contained in the developing device 100K. The details of the developing devices 100Y, 100M, 100C and 100K will be described later.

The optical writing device 44, used as a latent image forming device, emits light on the respective photoreceptor drums 210Y, 210M, 210C and 210K, and forms latent images on the respective surfaces of the photoreceptor drums 210Y, 210M, 210C and 210K.

The transfer device 60 has the intermediate transfer belt 62 used as a transfer body. The intermediate transfer belt 62, which is an endless belt, is supported with support rollers 64, 66, 68, 70 and 72, rotatably in an arrow direction in FIG. 2. At least one of the support rollers 64, 66, 68, 70 and 72 is connected to a motor (not shown), and rotated by driving transmission from the motor, thereby transmits the driving to the intermediate transfer belt 62.

Further, the transfer device 60 has first transfer rollers 80Y, 80M, 80C and 80K used as first transfer devices. The first transfer roller 80Y transfers the yellow toner image, formed on the surface of the photoreceptor drum 210Y by development of the latent image by the developing device 100Y, to the intermediate transfer belt 62. The first transfer roller 80M transfers the magenta toner image, formed on the surface of the photoreceptor drum 210M by development of the latent image by the developing device 100M, to the intermediate transfer belt 62. The first transfer roller 80C transfers the cyan toner image formed on the surface of the photoreceptor drum 210C by development of the latent image by the developing device 100C, to the intermediate transfer belt 62. The first transfer roller 80K transfers the black toner image formed on the surface of the photoreceptor drum 210K by developing the latent image by the developing device 100K, to the intermediate transfer belt 62.

Further, the transfer device 60 has a second transfer roller 84 used as a second transfer device. The second transfer roller 84 transfers the yellow toner image, the magenta toner image, the cyan toner image and the black toner image transferred to the intermediate transfer belt 62 to a recording sheet.

Further, the transfer device 60 has the cleaning device 90. The cleaning device 90 has a scraping member 92 which, after the transfer of the respective color toner images to the recording sheet by the second transfer roller 84, scrapes off the respective color toner remaining on the surface of the intermediate transfer belt 62. The toner scraped off by the scraping member 92 is recovered inside the main body of the cleaning device 90. The cleaning device 90 is attachable/removable in/from the image forming apparatus main body 16 via an opening formed by opening the sub opening/closing part 30.

Among the constituent elements of the transfer device 60, the intermediate transfer belt 62, the support rollers 64, 66, 68, 70 and 72, the first transfer rollers 80Y, 80M, 80C and 80K, and the cleaning device 90 are attached to the main opening/closing part 26. In the transfer device 60, the second transfer roller 84 is attached to the image forming apparatus main body 16.

Further, a fixing device 50 to fix the toner image, transferred by the second transfer roller 84 to the recording sheet is provided in the image forming apparatus main body 16.

Further, the developer recovery container 300 is provided in the image forming apparatus main body 16. The developer recovery container 300 is used as a discharged developer recovery container to recover developer discharged from at least two of the plural developer image forming parts 42Y, 42M, 42C and 42K. In the present exemplary embodiment, all the developer discharged from the four developer image forming parts 42Y, 42M, 42C and 42K is recovered in the developer recovery container 300. More particularly, in the present exemplary embodiment, the developer discharged from the developing devices 100Y, 100M, 100C and 100K of the developer image forming parts 42Y, 42M, 42C and 42K is recovered in the developer recovery container 300.

To convey the developer discharged from the developing devices 100Y, 100M, 100C and 100K to the developer recovery container 300, a developer recovery passage 360 (not shown in FIGS. 1 and 2, see FIG. 11) provided in the image forming apparatus main body 16 is used.

It is arranged such that the developer discharged from the developer image forming part 42 is recovered in the developer recovery container 300. Accordingly, it may be arranged such that, in place of recovery of the developer discharged from the developing device 100 of the developer image forming part 42 into the developer recovery container 300 as in the case of the present exemplary embodiment or along with recovery of the developer discharged from the developing device 100 into the developer recovery container 300, for example, developer which has been discharged from the developer image forming part 42 such as developer removed from the surface of the photoreceptor drum 210 and other than the developer discharged from the developing device 100, is recovered into the developer recovery container 300.

Further, it is arranged such that developer recovered from at least two of the developer image forming parts 42Y, 42M, 42C and 42K is recovered in the developer recovery container 300. Accordingly, it may be arranged such that, in place of recovery of developer recovered from the developer image forming parts 42Y, 42M, 42C and 42K as all the developer image forming parts of the image forming apparatus 10 into the developer recovery container 300 as in the case of the present exemplary embodiment, developer discharged from selected two or more of the developer image forming parts 42Y, 42M, 42C and 42K is recovered into the developer recovery container 300.

Further, the developer recovery container 300, integrated with the photoreceptor unit 200K, is attached/removed, integrally with the photoreceptor unit 200K, in/from the image forming apparatus main body 16. Further, it may be arranged such that, in place of integration of the developer recovery container 300 with the photoreceptor unit 200K, one of the photoreceptor units 200Y, 200M and 200C is integrated with the developer recovery container 300, and the developer recovery container 300, integrally with one of the photoreceptor units 200Y, 200M and 200C, is attached/removed in/from the image forming apparatus main body 16.

Further, the recording sheet supply device 510 to supply a recording sheet to the image forming part 40 is attached in the image forming apparatus main body 16. The recording sheet supply device 510 can be drawn to the front side of the image forming apparatus main body 16 (right side in FIG. 2). In a state where the recording sheet supply device 510 is drawn from the image forming apparatus main body 16, the recording sheets are replenished.

The recording sheet supply device 510 has a recording sheet container 512 containing the recording sheets such as normal paper in a stacked state. Further, the recording sheet supply device 510 has a conveyance roller 514 to extract a top recording sheet contained in the recording sheet container 512 and convey the extracted recording sheet toward the image forming part 40. Further, the recording sheet supply device 510 has a retard roller 516 to retard the recording sheets for prevention of a multi-feed state of plural overlapped recording sheets to the image forming part 40.

Further, a conveyance passage 530 used for conveyance of the recording sheet is formed in the image forming apparatus main body 16. The conveyance passage 530 has a main conveyance passage 532, a reverse conveyance passage 534, and a sub conveyance passage 536.

The main conveyance passage 532 is used for conveyance of the recording sheet supplied from the recording sheet supply device 510 to the image forming part 40, and discharge of a recording sheet on which an image is formed to the outside of the image forming apparatus main body 16. The above-described conveyance roller 514 and the retard roller 516, a registration roller 542, the above-described second transfer roller 84, the above-described fixing device 50, and a discharge roller 544, are provided along the main conveyance passage 532, sequentially from the upstream side in the direction where the recording sheet is conveyed.

The registration roller 542 temporarily stops the end of the recording sheet conveyed from the recording sheet supply device 510 side, and sends the recording sheet toward the second transfer roller 84, at the timing of transfer of respective color toner images to the intermediate transfer belt 62.

The discharge roller 544 discharges the recording sheet to which the respective color toner images are fixed by the fixing device 50 to the outside of the image forming apparatus main body 16.

The reverse conveyance passage 534 is used for supply of a recording sheet where a toner image is formed on one side again toward the image forming part 40 while reversing the recording sheet. For example, two reverse conveyance rollers 548 are provided along the reverse conveyance passage 534. A recording sheet is supplied from the rear end side to the reverse conveyance passage 534 by reverse rotation of the discharge roller 544 holding the rear end of the recording sheet, and the supplied recording sheet is conveyed to a position upstream of the registration roller 542 with the reverse conveyance rollers 548.

The sub conveyance passage 536 is used for supply of a recording sheet, different from the recording sheet contained in the recording sheet supply device 510, to the image forming part 40. The recording sheet is supplied to the sub conveyance passage 536 from the front side of the image forming apparatus main body 16 in a state where the supply opening/closing part 22 is opened. A conveyance roller 552 and a retard roller 554 are provided along the sub conveyance passage 536. The conveyance roller 552 conveys the recording sheet supplied to the sub conveyance passage 536 toward the image forming part 40. The retard roller 554 is used for retarding the recording sheet supplied to the sub conveyance passage 536 and for prevention of multi-feed of plural overlapped recording sheets to the image forming part 40.

Figure 3:
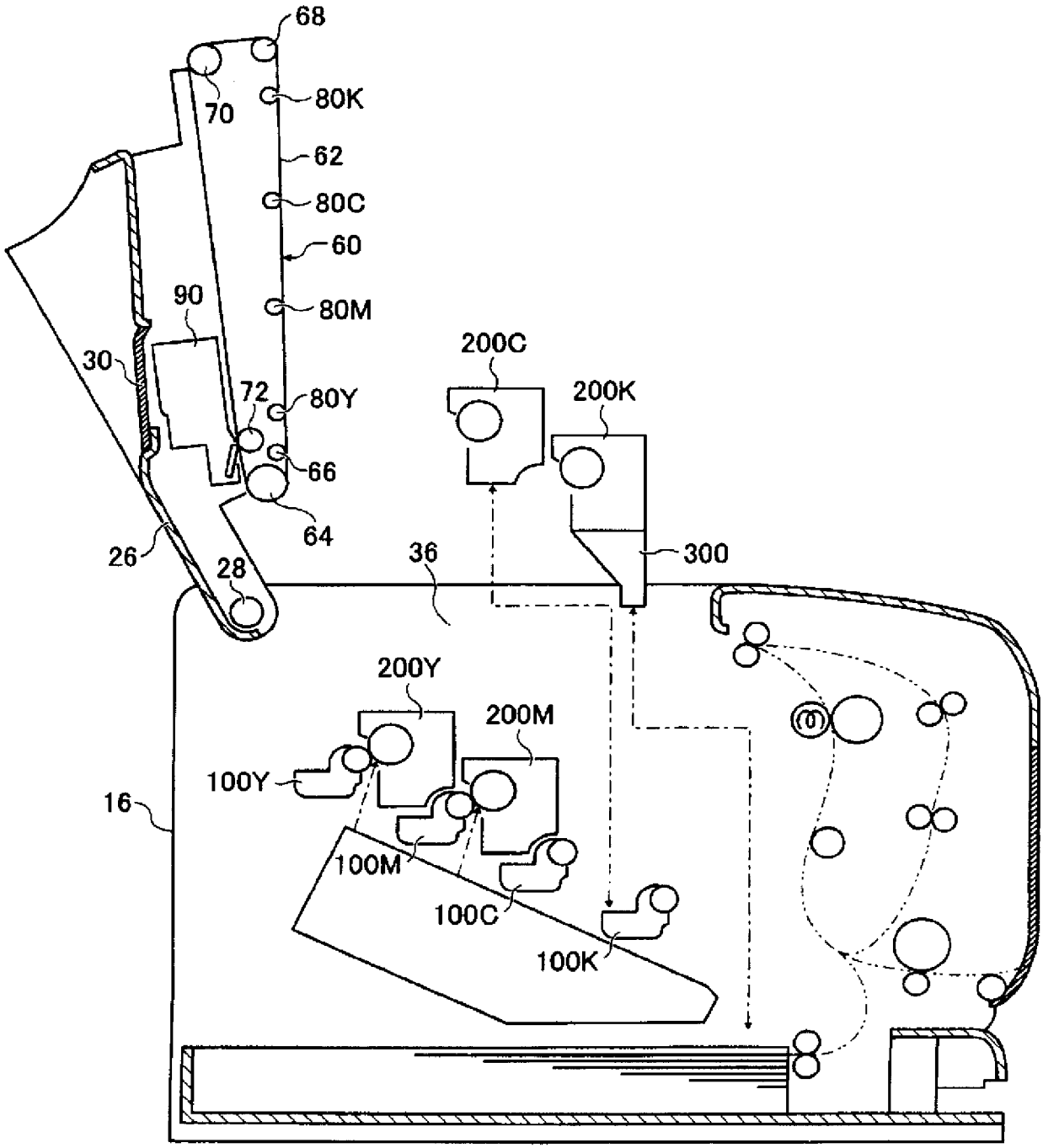
FIG. 3 is a cross-sectional diagram showing attachment/removal of an image forming structure and a discharged developer recovery container in/from the image forming apparatus shown in FIG. 1.
Figure 4:
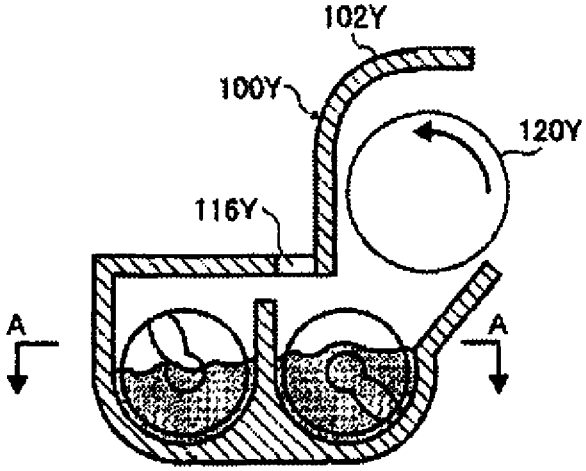
Figure 5:
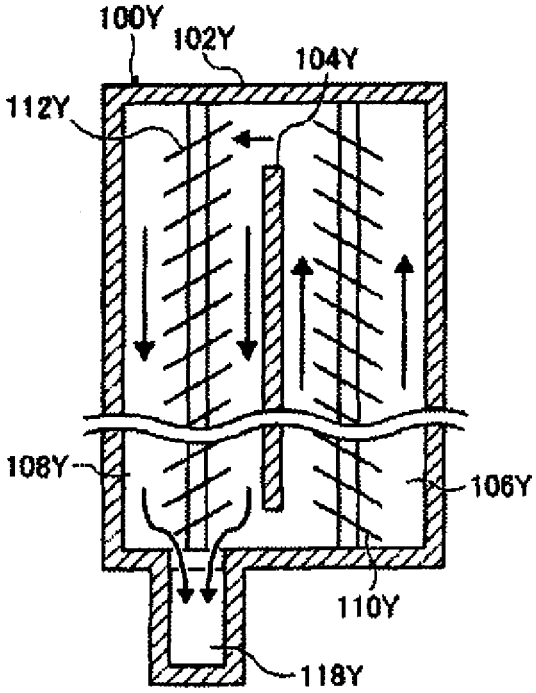
Figure 6:
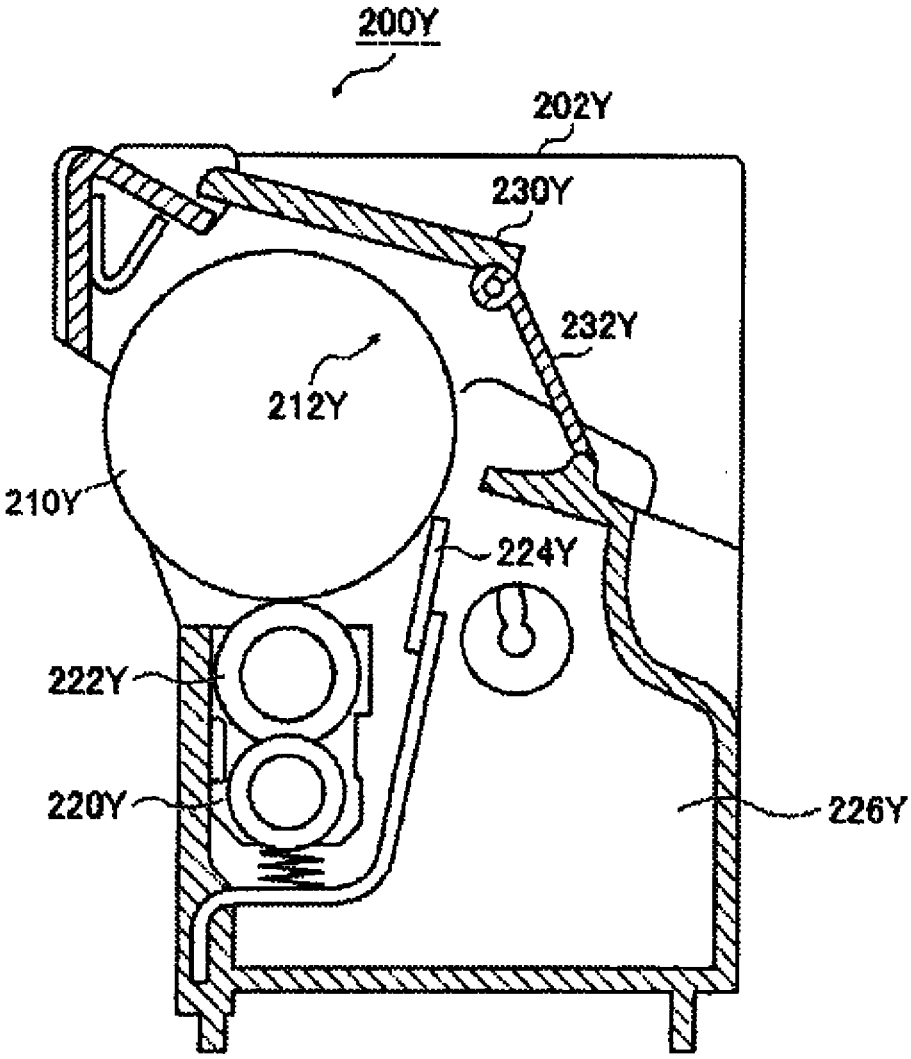
Figure 7:
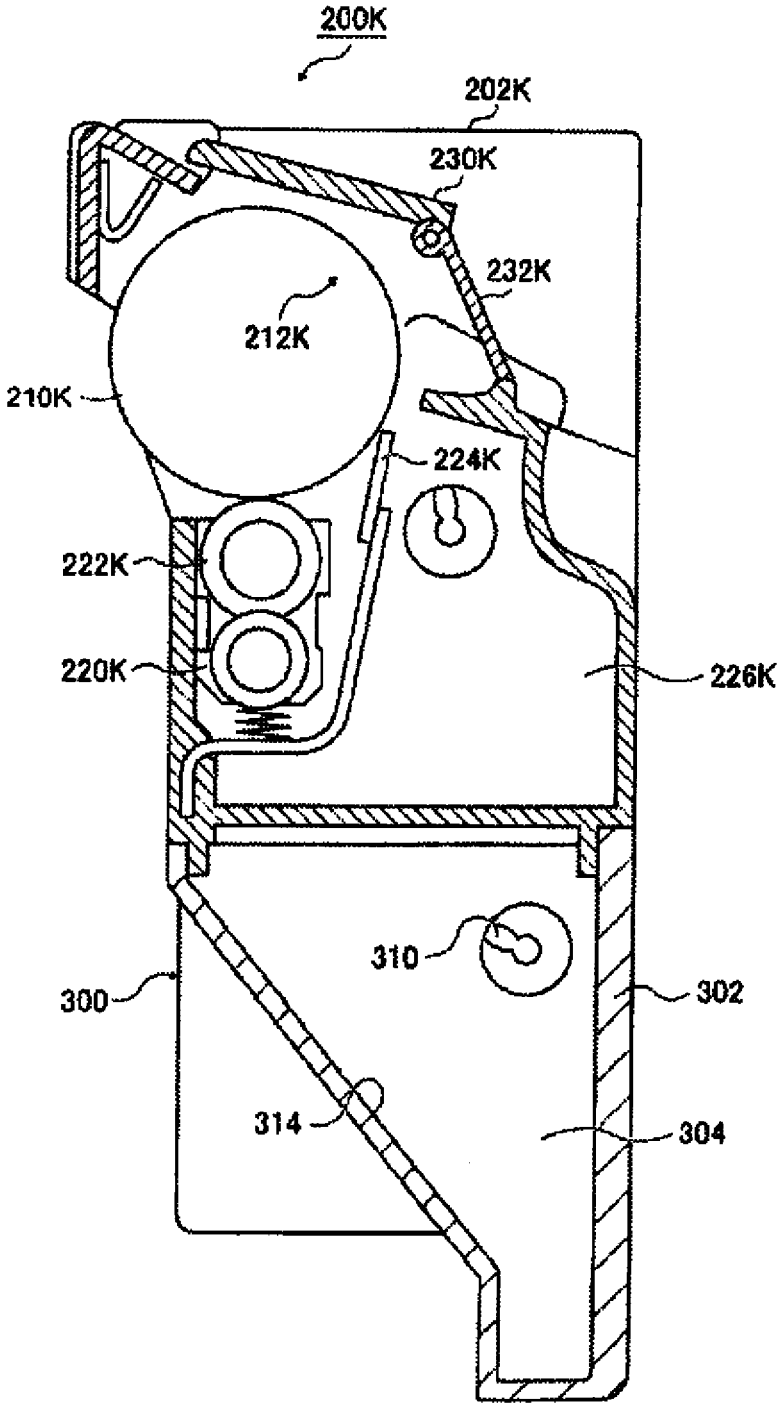
Figure 8:
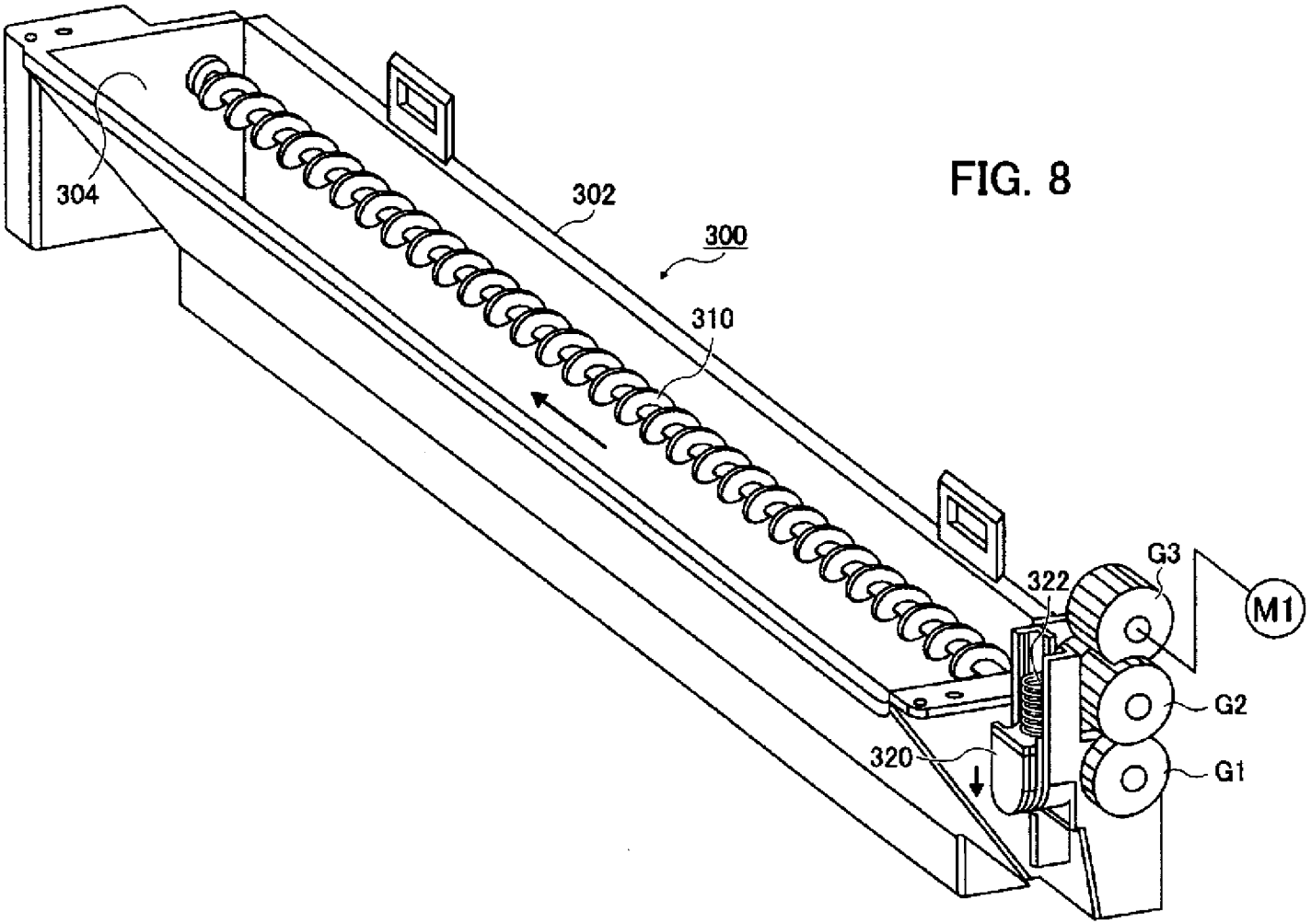
Figure 9:
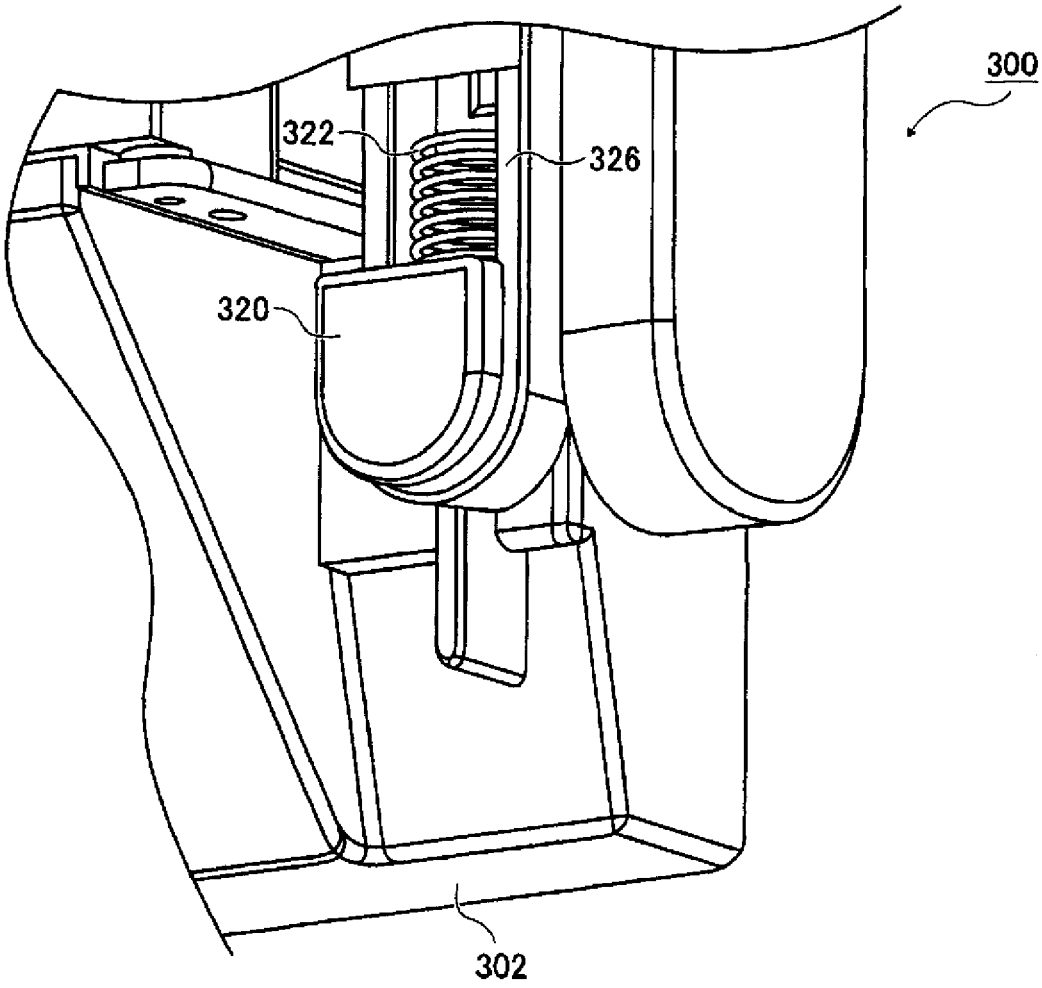
Figure 10:
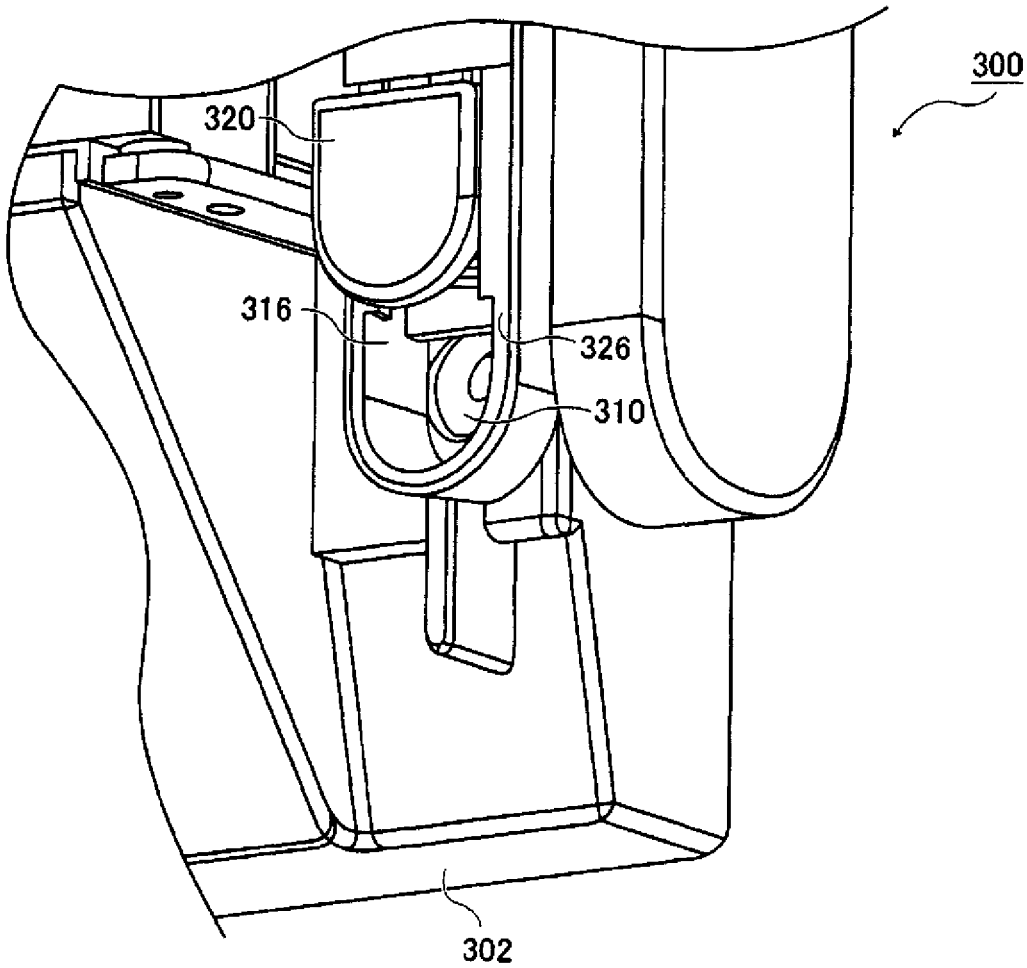
Figure 11:
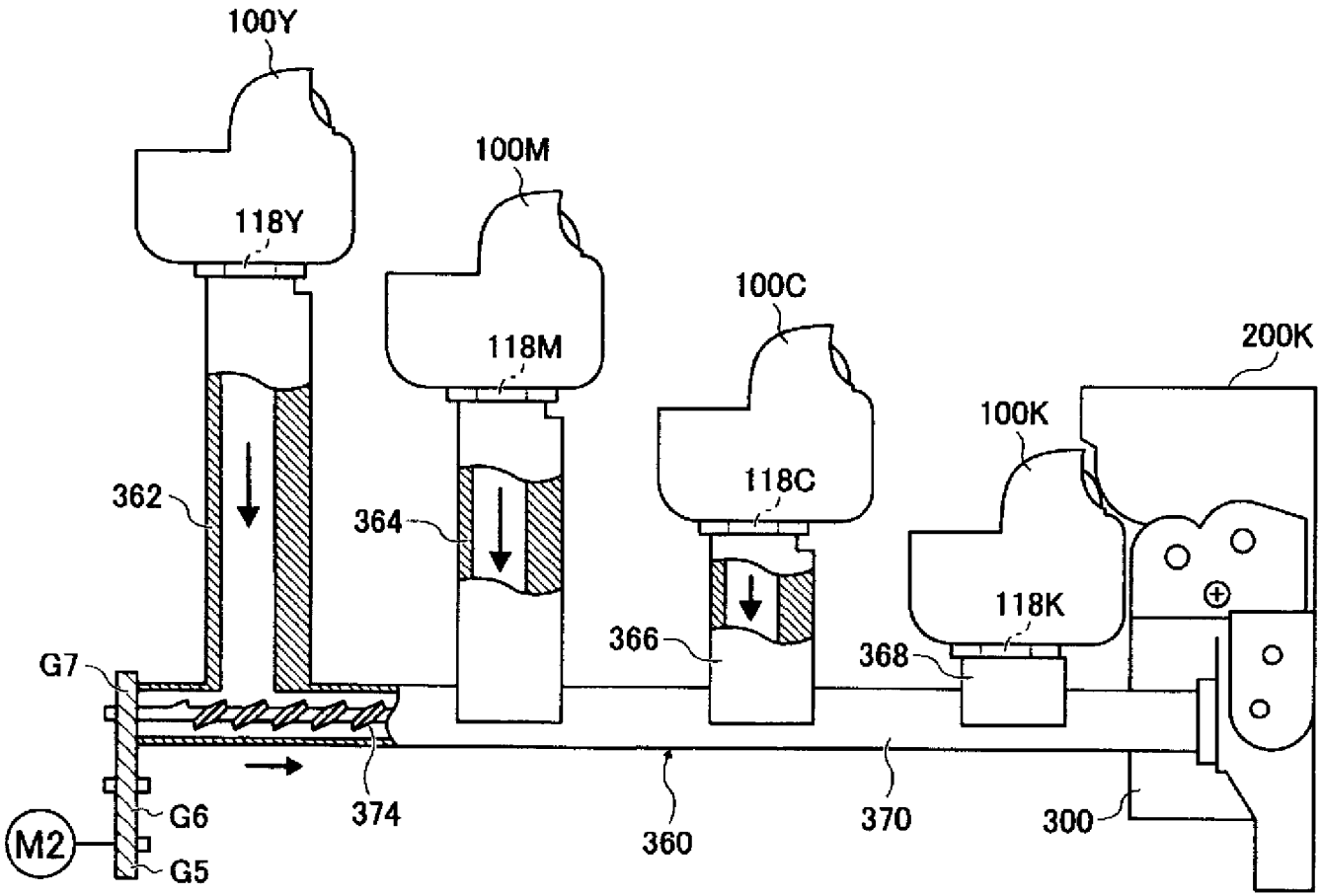

FIG. 3 shows attachment/removal of the photoreceptor unit 200 and the developer recovery container 300 in/from the image forming apparatus main body 16. As shown in FIG. 3, when the main opening/closing part 26 is opened with respect to the image forming apparatus main body 16, the intermediate transfer belt 62, the support rollers 64, 66, 68, 70 and 72, the first transfer rollers 80Y, 80M, 80C and 80K, and the cleaning device 90 of the transfer device 60 move along with the main opening/closing part 26, and an opening 36 is formed in the image forming apparatus main body 16. Then, the photoreceptor units 200Y, 200M, 200C and 200K are respectively attached/removed in/from the image forming apparatus main body 16 via the opening 36. The developer recovery container 300 is integrated with the photoreceptor unit 200K as described above. Accordingly, the developer recovery container 300 is attached/removed in/from the image forming apparatus main body 16, integrally with the photoreceptor unit 200K.

Figure 4:
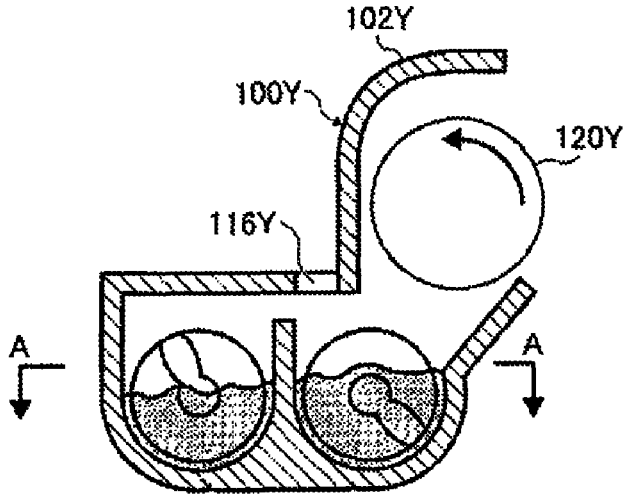
FIG. 4 is a cross-sectional diagram showing a developing device used in the image forming apparatus shown in FIG. 1 viewed from a left side surface.
Figure 5:
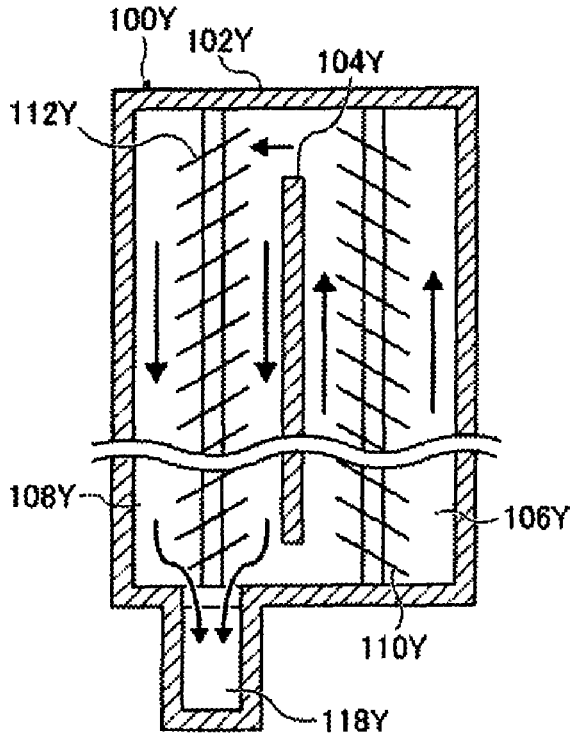
FIG. 5 is a cross-sectional diagram of the developing device shown in FIG. 4 along a line A-A in FIG. 4.

FIGS. 4 and 5 show the developing device 100Y. Though the developing devices 100M, 100C and 100K use different developer, these developing devices 100M, 100C, and 100K have the same structure as that of the developing device 100Y described below, accordingly, the explanation of the structures of the developing devices 100M, 100C, and 100K will be omitted.

The developing device 100Y is a two-component developing device to develop a latent image using two-component developer including toner and carrier. The developing device 100Y has a developing device main body 102Y, and contains the developer in the developing device main body 102Y.

A developing roller 120Y used as a developer holder is attached in the developing device main body 102Y. The developing roller 120Y rotates in an arrow direction in FIG. 4, supplies developer held on its surface to the photoreceptor drum 210Y (see FIG. 1), to develop a latent image formed on the surface of the photoreceptor drum 210Y.

The space in the developing device main body 102Y is separated into e.g. two spaces by e.g. one partition member 104Y, and the partitioned spaces are respectively used as conveyance passages 106Y and 108Y. The conveyance passages 106Y and 108Y are used as passages for conveyance of the developer in the developing device main body 102Y. Conveyance members 110Y and 112Y to convey the developer while stirring the developer are attached in the conveyance passages 106Y and 108Y.

Further, a supply hole 116Y and a discharge hole 118Y are formed in the developing device main body 102Y. The developer is supplied from a developer container (not shown) via the supply hole 116Y into the developing device main body 102Y. Further, the developer is discharged via the discharge hole 118Y to the outside of the developing device main body 102Y.

In the developing device 100Y having the above structure, the developer supplied via the supply hole 116Y in the developing device main body 102Y is conveyed in the conveyance passage 106Y by the conveyance member 110Y, and conveyed in the conveyance passage 108Y by the conveyance member 110Y. Then, e.g. some of the developer is finally discharged via the discharge hole 118Y to the outside of the developing device main body 102Y. In this manner, new developer is supplied into the developing device main body 102Y, and excessive developer is discharged, thereby development is performed using newly supplied developer without continuously using developer including depleted carrier.

Figure 6:
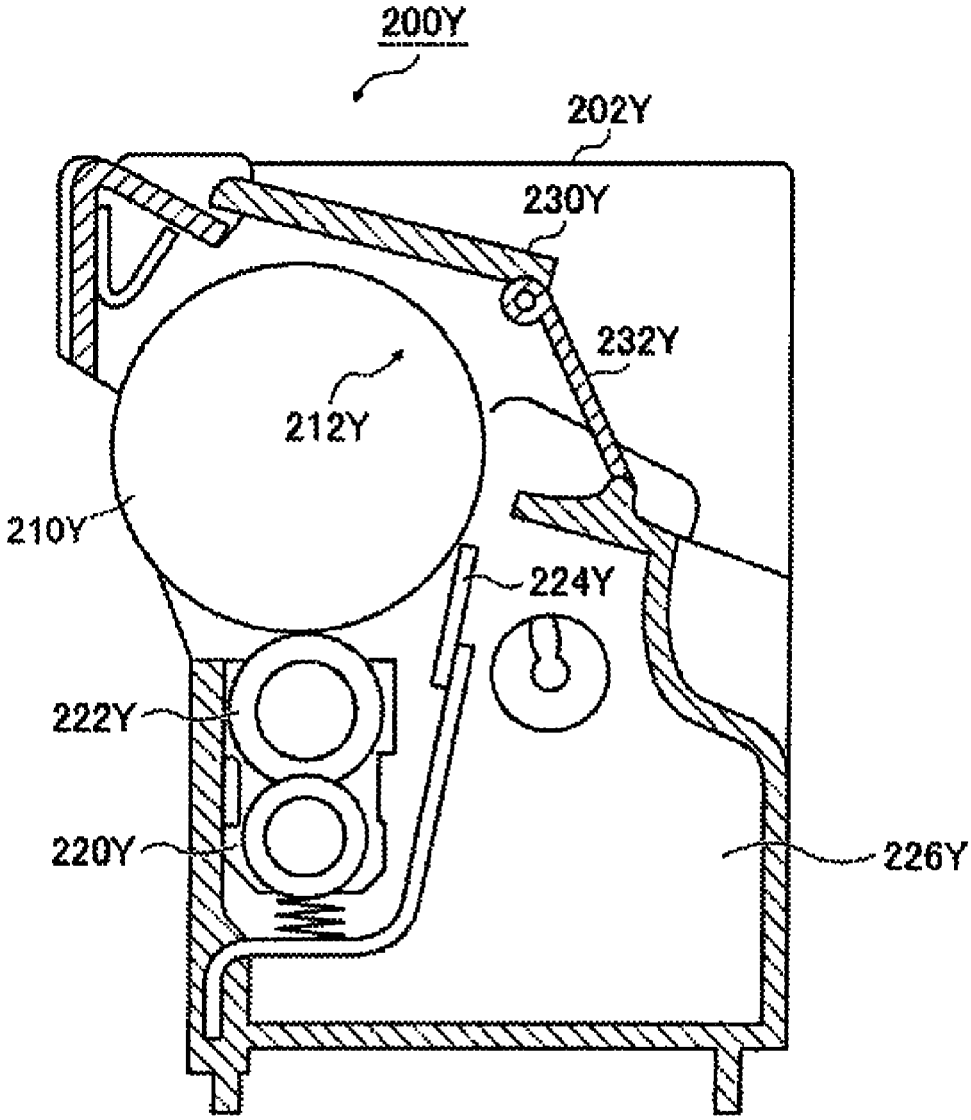
FIG. 6 is a cross-sectional diagram showing an image forming structure used in the image forming apparatus shown in FIG. 1.

FIG. 6 shows the photoreceptor unit 200Y. Though the photoreceptor units 200M and 200C use different developer, these photoreceptor units 200M and 200C have the same structure as that of the photoreceptor unit 200Y described below, accordingly, the explanation of the photoreceptor units 200M and 200C will be omitted. As shown in FIG. 6, the photoreceptor unit 200Y has a photoreceptor unit main body 202Y, to which the above-described photoreceptor drum 210Y is attached. A part of the photoreceptor drum 210Y can be exposed to the outside of the photoreceptor unit main body 202Y as an exposed part 212Y.

A charging device 220Y to uniformly charge the surface of the photoreceptor drum 210Y is attached in the photoreceptor unit main body 202Y. The charging device 220Y has a charging roller 222Y in contact with the photoreceptor drum 210Y. The optical writing device 44 (see FIG. 1) writes a latent image on the surface of the photoreceptor drum 210Y uniformly charged by the charging device 220Y.

Further, a scraping member 224Y used as a cleaning device is attached in the photoreceptor unit main body 202Y. When a yellow toner image has been transferred with the first transfer roller 80Y (see FIG. 1) to the intermediate transfer belt 62, the scraping member 224Y scrapes off the yellow toner remaining on the surface of the photoreceptor drum 210Y. Further, a recovery chamber 226Y to recover the toner scraped off by the scraping member 224Y from the surface of the photoreceptor drum 210Y is provided in the photoreceptor unit main body 202Y.

Further, a shutter 230Y is attached via a support member 232Y to the photoreceptor unit main body 202Y. The support member 232Y and the shutter 230Y are used as an opening/closing part to open/close so as to move between a position to cover the exposed part 212Y of the photoreceptor drum 210Y (hereinbelow, a covering position) and a position to expose the exposed part 212Y from the photoreceptor unit main body 202 (hereinbelow, an exposing position). FIG. 6 shows the shutter 230Y and the support member 232Y moved to the covering position.

In a state where the photoreceptor unit 200Y is not attached in the image forming apparatus main body 16, the shutter 230Y and the support member 232Y are in the covering position. Further, when the photoreceptor unit 200Y is attached in the image forming apparatus main body 16 and the main opening/closing part 26 is opened with respect to the image forming apparatus main body 16, the shutter 230Y and the support member 232Y are in the covering position.

In a state where the photoreceptor unit 200Y is attached in the image forming apparatus main body 16, when the main opening/closing part 26 is closed with respect to the image forming apparatus main body 16, in accordance with the closing of the main opening/closing part 26, the shutter 230Y and the support member 232Y move to the exposing position. Further, when the main opening/closing part 26 is opened with respect to the image forming apparatus main body 16, in accordance with the opening of the main opening/closing part 26, the shutter 230Y and the support member 232Y move to the covering position.

The linkage between the opening/closing of the main opening/closing part 26 and that of the shutter 230Y and the support member 232Y is realized with a link mechanism (not shown).

Figure 7:
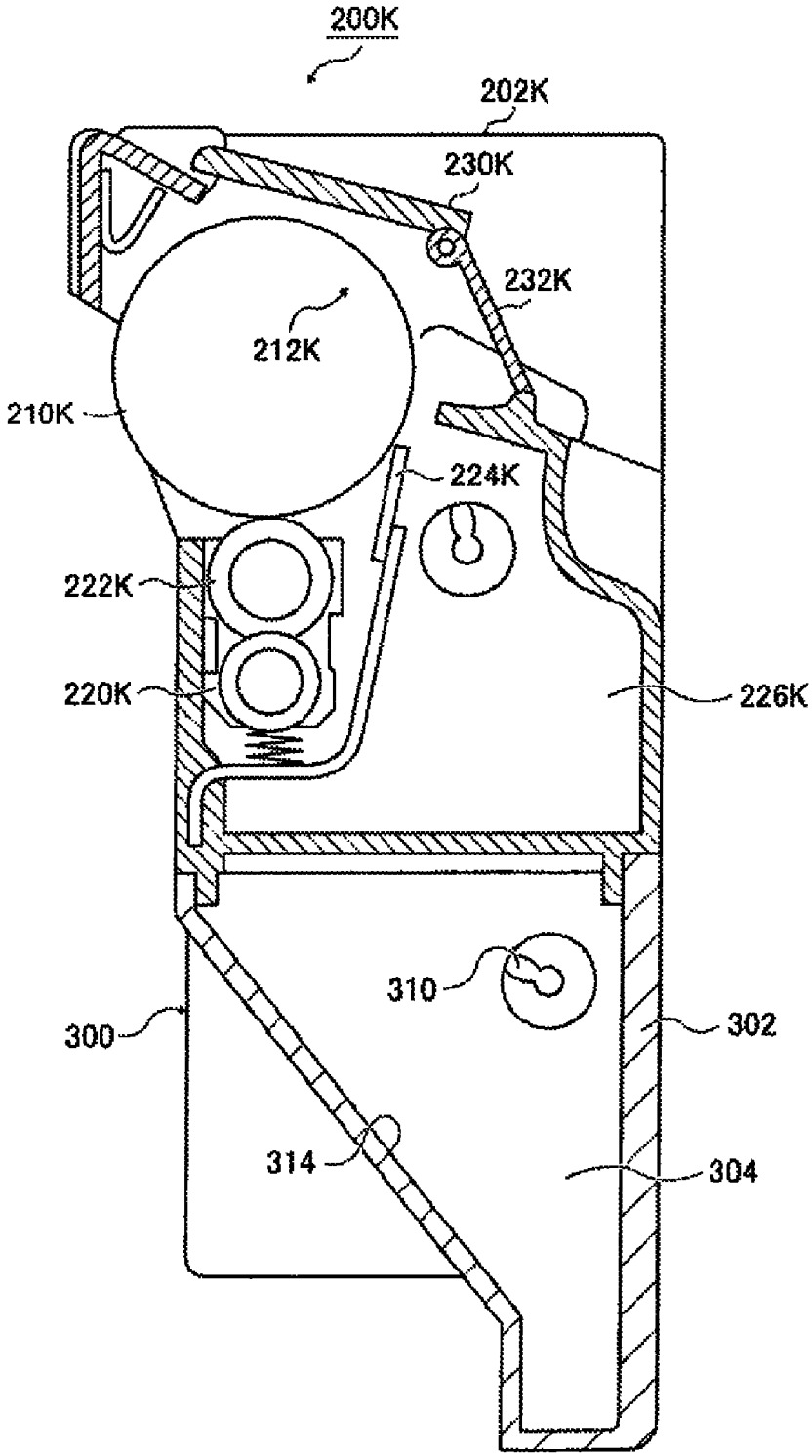
FIG. 7 is a cross-sectional diagram showing the image forming structure and the discharged developer recovery container used in the image forming apparatus shown in FIG. 1.

FIG. 7 shows the photoreceptor unit 200K and the developer recovery container 300. Since the photoreceptor unit 200K has the same structure as that of the above-described photoreceptor unit 200Y, suffixes in the figure are replaced with "K", the same reference numerals are given, and the detailed explanation of FIG. 7 will be omitted. The recovery chamber 226K is used as a removed developer recovery part to recover developer removed from the photoreceptor drum 210K. The recovery chamber 226K is space independent of the developer recovery container 300. The developer including toner and carrier discharged from the developing device 100Y is recovered into the developer recovery container 300, whereas the toner removed from the surface of the photoreceptor drum 210K is recovered into the recovery chamber 226K.

The developer recovery container 300 has a developer recovery container main body 302, and a developer recovery chamber 304 is formed in the developer recovery container main body 302. Further, a conveyance member 310 to convey developer is attached in the developer recovery chamber 304. A slope 314 is formed in a part of an inner surface of the developer recovery container main body 302. The developer recovered in the developer recovery container 300 slips on the slope 314 and drops toward the bottom of the developer recovery chamber 304.

The developer recovery container 300 is attachable/removable to/from the photoreceptor unit main body 202Y. Accordingly, it may be arranged such that in the stage of manufacture, the photoreceptor unit 200K having the same structure as that of the photoreceptor units 200Y, 200M and 200C is manufactured with the same material as that of the photoreceptor units 202Y, 202M and 202C and at the same process as that for the photoreceptor units 202Y, 202M and 202C, and the developer recovery container 300 is attached to the manufactured photoreceptor unit 200K.

Figure 8:
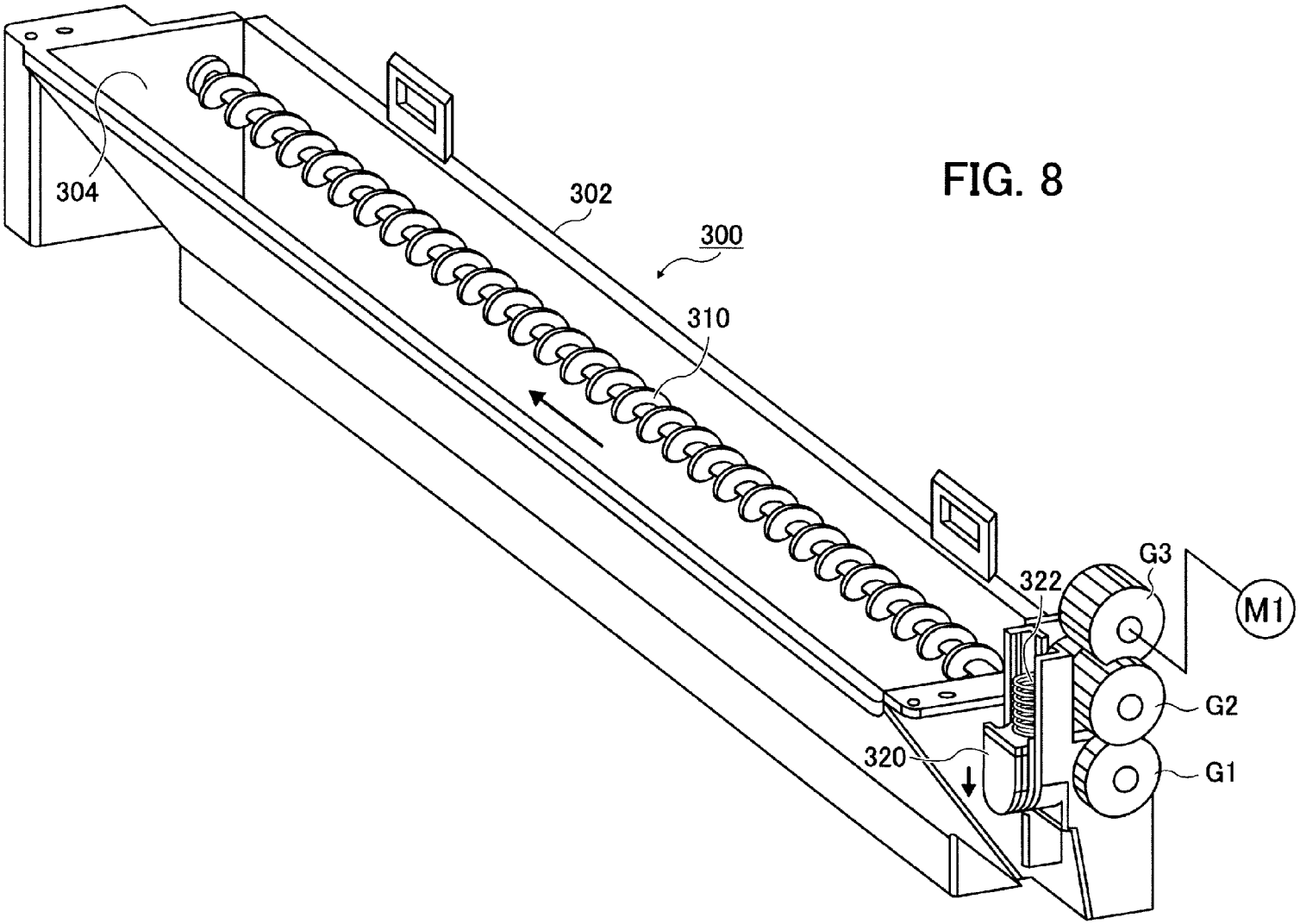
FIG. 8 is a perspective diagram showing the discharged developer recovery container shown in FIG. 7.

FIG. 8 shows the developer recovery container 300.

As shown in FIG. 8, an upward surface of the developer recovery container 300 is an open part. The open part is sealed by attaching the developer recovery container 300 to the photoreceptor unit 200K. An end of the conveyance member 310 is projected to the outside of the developer recovery container main body 302, and a gear G1 is attached to the projected portion. As shown in FIG. 8, driving from a motor M1 is transmitted to the conveyance member 310 via the gear G1, a gear G2 and a gear G3. The conveyance member 310, rotated by the driving transmitted from the motor M1, conveys the recovered developer in an arrow direction in FIG. 8.

An opening/closing member 320 is attached to the developer recovery container main body 302. The opening/closing member 320 is used as an opening/closing part to open/close an opening 316 (see FIG. 10). A pressing member 322 of an elastic body such as a coil spring is attached to the opening/closing member 320. The opening/closing member 320 is pushed downward with the pressing member 322 as indicated with an arrow in FIG. 8.

Figure 9:
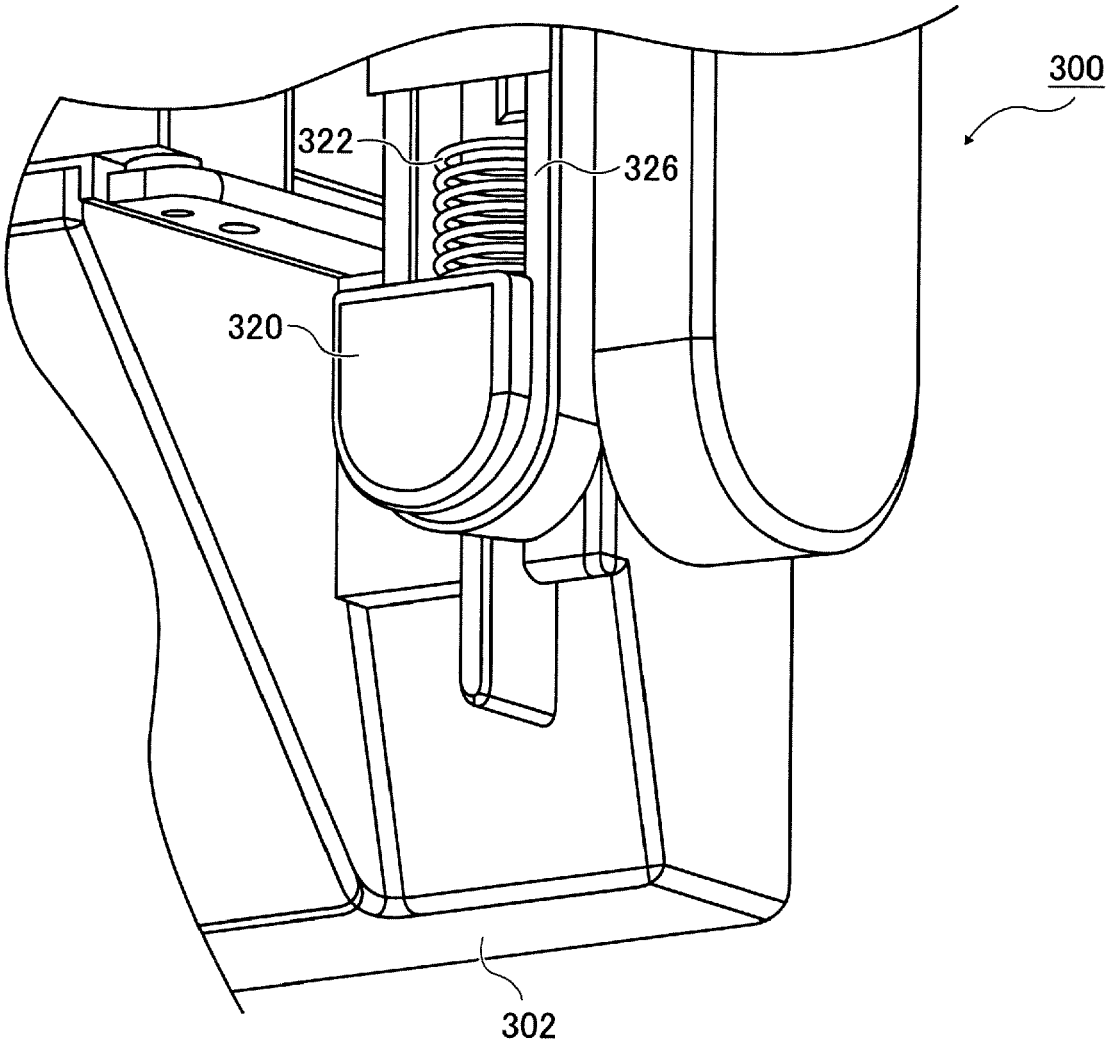
FIG. 9 is a first expanded perspective diagram showing an opening/closing part of the discharged developer recovery container shown in FIG. 7.
Figure 10:
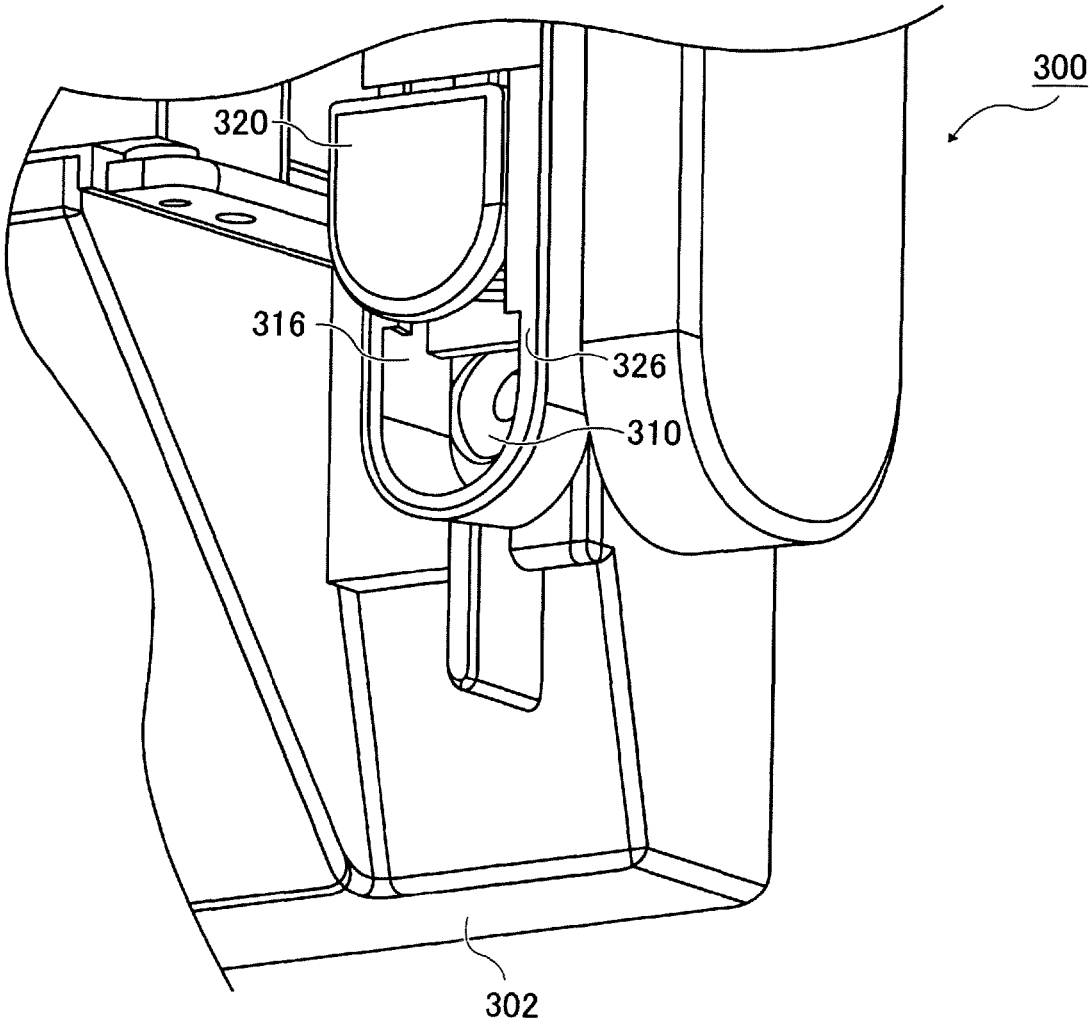
FIG. 10 is a second expanded perspective diagram showing the opening/closing part of the discharged developer recovery container shown in FIG. 7.

FIGS. 9 and 10 show expanded views of a part of the developer recovery container 300 around a position to which the opening/closing member 320 is attached. FIG. 9 shows the developer recovery container 300 not attached in the image forming apparatus main body 16, and FIG. 10 shows the developer recovery container 300 attached in the image forming apparatus main body 16.

In the developer recovery container main body 302, the opening 316 used for recovery of developer is formed on the upper end side. Through the opening 316, developer discharged from the developing devices 100Y, 100M, 100C and 100K is recovered into the developer recovery container 300.

The opening/closing member 320 is guided with a guide part 326 formed in the developer recovery container main body 302, thereby moved in the moved-down position shown in FIG. 9 and the moved-up position shown in FIG. 10. As described above, since the opening/closing member 320 is pushed with the pressing member 322 downward, the opening/closing member 320 is generally in the moved-down position. When the opening/closing member 320 is in the moved-down position, the opening 316 is closed with the opening/closing member 320.

When the developer recovery container 300 is attached in the image forming apparatus main body 16 in the state where the opening/closing member 320 is in the moved-down position, in accordance with the attachment of the developer recovery container 300 in the image forming apparatus main body 16, the opening/closing member 320 is pressed upward with a pressing part (not shown) provided on the image forming apparatus main body 16 side. The opening/closing member 320 which is pressed is moved to the moved-up position, then the opening 316 goes into an opened state.

When the developer recovery container 300 is removed from the image forming apparatus main body 16, since the above-described pressing to the opening/closing member 320 with the pressing part is released, the opening/closing member 320, pushed with the pressing member 322, is moved to the moved-down position, and by the movement of the opening/closing member 320 to the moved-down position, the opening 316 goes into a closed state.

Figure 11:
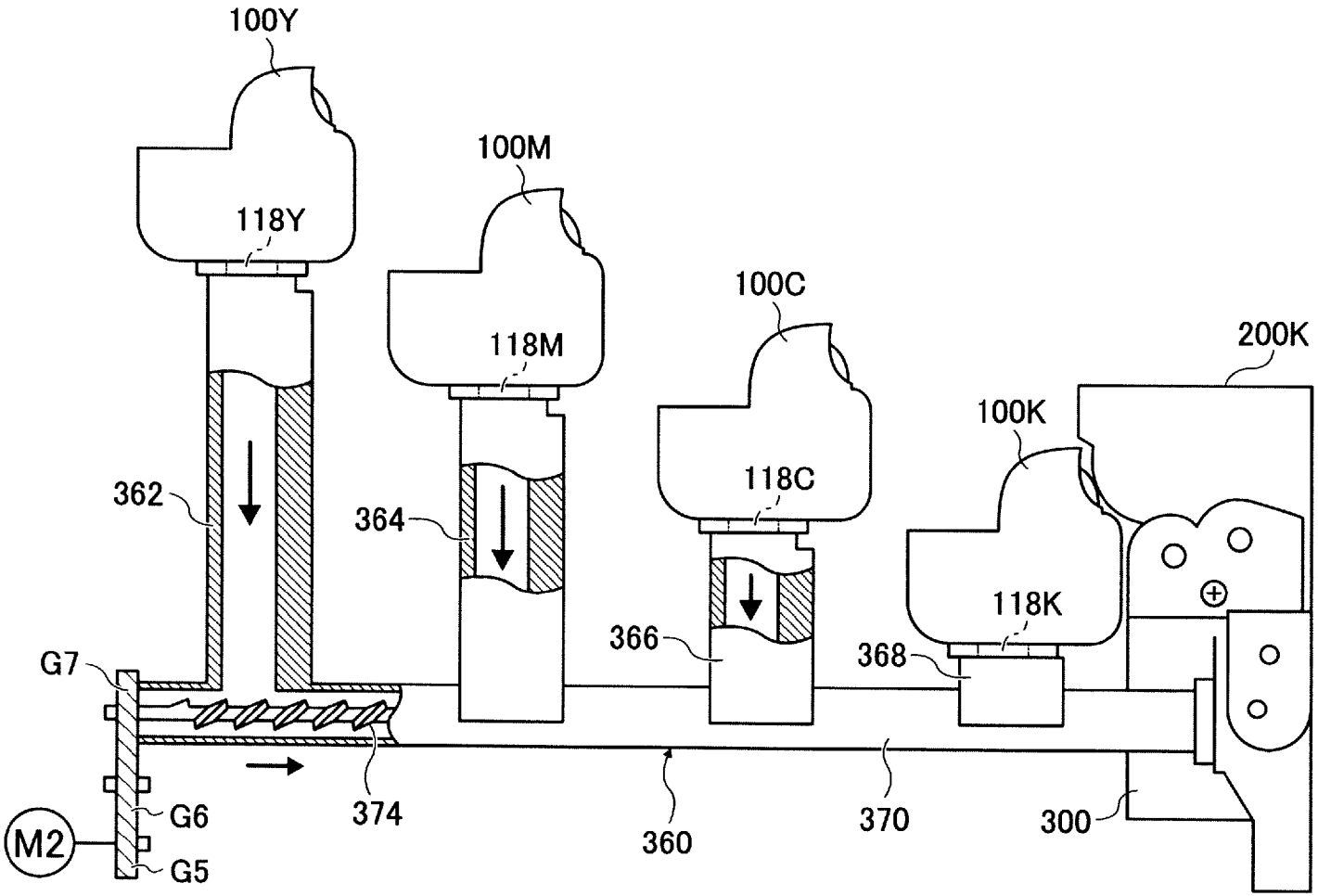
FIG. 11 is a partial cut-away diagram showing a developer conveyance passage in the image forming apparatus shown in FIG. 1.
Figure 1:
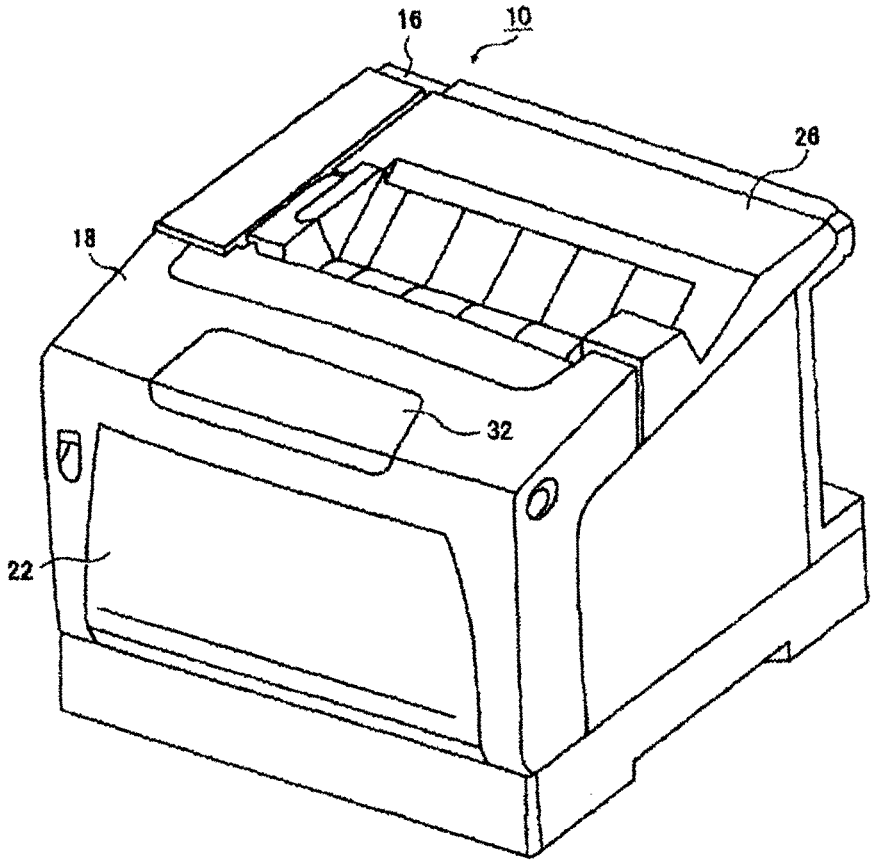
Figure 2:
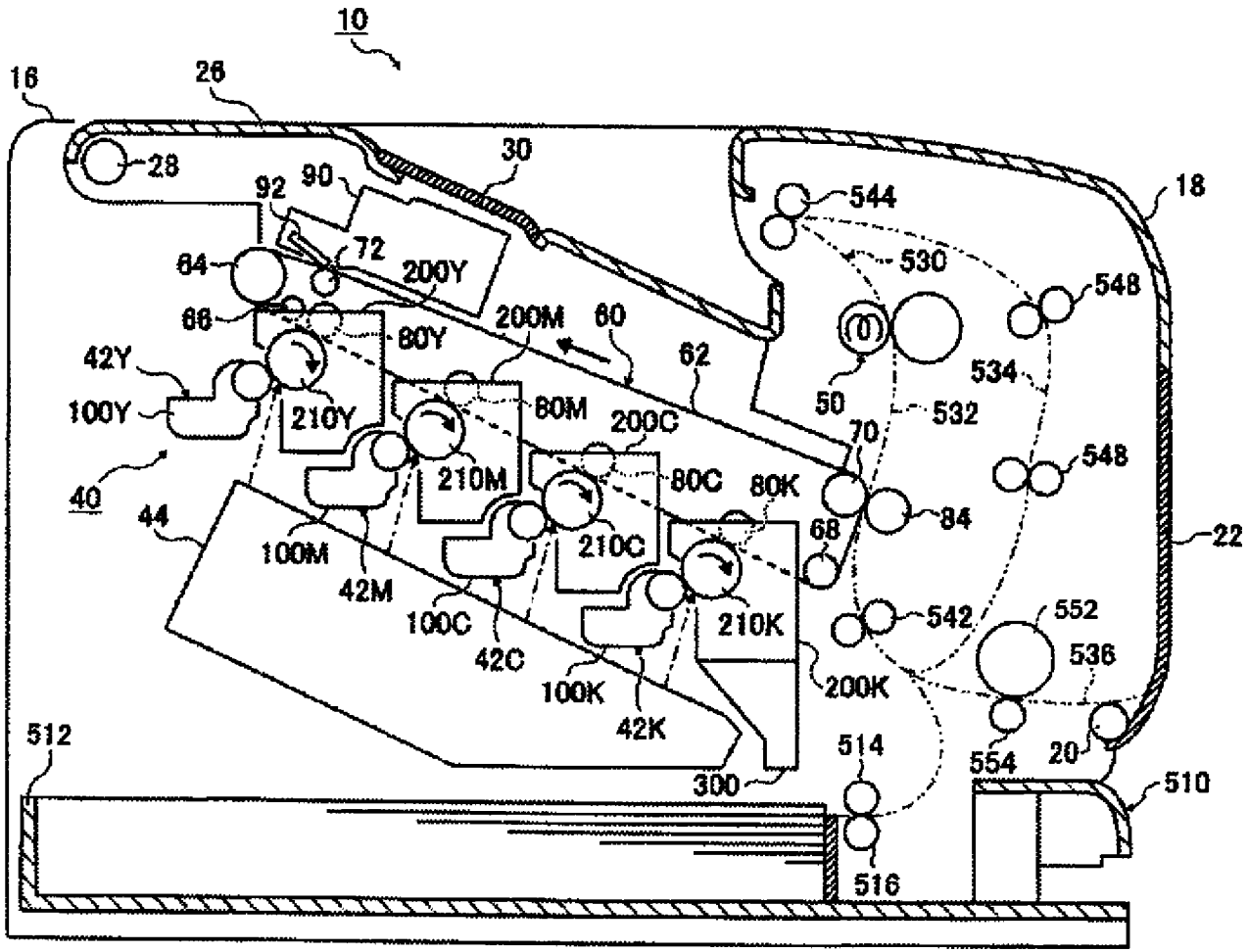

FIG. 11 shows the developer recovery passage 360.

The developer recovery passage 360 is used for recovery of developer, discharged from the discharge holes 118Y, 118M, 118C and 118K formed in the developing devices 100Y, 100M, 100C and 100K, into the developer recovery container 300.

The developer recovery passage 360 has vertical parts 362, 364, 366 and 368 extending in an approximately vertical direction, and a horizontal part 370, extending approximately horizontally, connected to the vertical parts 362, 364, 366 and 368. The vertical part 362 has a hollow shape such as a pipe. The upper end side of the vertical part 362 is connected to the discharge hole 118Y, such that yellow developer discharged from the discharge hole 118Y drops inside the vertical part 362 to the horizontal part 370.

Further, the vertical part 364 has a hollow shape such as a pipe. The upper end side of the vertical part 364 is connected to the discharge hole 118M, such that magenta developer discharged from the discharge hole 118M drops inside the vertical part 364 to the horizontal part 370. Further, the vertical part 366 has a hollow shape such as a pipe. The upper end side of the vertical part 366 is connected to the discharge hole 118C, such that cyan developer discharged from the discharge hole 118C drops inside the vertical part 366 to the horizontal part 370. Further, the vertical part 368 has a hollow shape such as a pipe. The upper end side of the vertical part 368 is connected to the discharge hole 118K, such that black developer discharged from the discharge hole 118K drops inside the vertical part 368 to the horizontal part 370.

The horizontal part 370 has a hollow shape such as a pipe. A conveyance part 374 to convey developer is inserted in the hollow part. Driving is transmitted from a motor M2 via a gear G5, a gear G6 and a gear G7, to the conveyance part 374. The conveyance part 374, rotated by the driving transmitted from the motor M2, conveys the developer drop-conveyed from the vertical parts 362, 364, 366 and 368 toward the developer recovery container 300.

As described above, the present invention is applicable to an image forming apparatus such as a copier, a printer and a facsimile apparatus, an image forming structure attached/removed in/from the image forming apparatus, and a developer recovery container.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The exemplary embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image forming apparatus main body;

a plurality of developer image forming parts provided in the image forming apparatus main body that form a developer image; and a discharged developer recovery container that recovers developer discharged from at least two of the plurality of developer image forming parts, each of the plurality of developer image forming parts having an image forming structure having only one image holder that holds the developer image, and the image forming structure in the at least one developer image forming part and the discharged developer recovery container being attached/removed, integrally with each other, in/from the image forming apparatus main body.

2. The image forming apparatus according to claim 1, wherein the image holder of the image forming structure attached/removed in/from the image forming apparatus main body integrally with the discharged developer recovery container holds a black developer image.

3. The image forming apparatus according to claim 1, wherein the plurality of developer image forming parts respectively have a developing device that develops a latent image, and the discharged developer recovery container recovers the developer discharged from at least two of the developing devices.

4. The image forming apparatus according to claim 3, wherein the image forming structure has a removed developer recovery part that recovers developer removed from the image holder.

5. The image forming apparatus according to claim 1, wherein an opening used for recovery of the developer is formed on an upper end side of the discharged developer recovery container.

6. The image forming apparatus according to claim 5, wherein the discharged developer recovery container has an opening/closing part to open/close the opening.

7. The image forming apparatus according to claim 6, wherein the opening/closing part sets the opening into an opened state in accordance with an operation to attach the discharged developer recovery container in the image forming apparatus main body, and sets the opening into a closed state in accordance with an operation to remove the discharged developer recovery container from the image forming apparatus main body.

8. The image forming apparatus according to claim 1, wherein the discharged developer recovery container has a conveyance member that conveys recovered developer in the discharged developer recovery container.

9. The image forming apparatus according to claim 1, wherein the discharged developer recovery container is attachable/removable in/from the image forming structure.

10. The image forming apparatus according to claim 1, wherein the plurality of developer image forming parts are arranged in different positions in the direction of gravity.

11. An image forming structure comprising an image holder that holds a developer image, attached/removed in/from an image forming apparatus main body, integrally with a discharged developer recovery container that recovers developer discharged from a plurality of developer image forming parts that form the developer image, and each of the plurality of developer image forming parts having only one image holder that holds the developer image.

12. An image forming structure comprising:

an image holder that holds a developer image;

a discharged developer recovery chamber that recovers developer discharged from a plurality of developer image forming parts that form the developer image, the image forming structure being attached/removed in/from an image forming apparatus main body, and each of the plurality of developer image forming parts having only one image holder that holds the developer image.

13. A developer recovery container that recovers developer discharged from a plurality of developer image forming parts that form a developer image, attached/removed in/from an image forming apparatus main body, integrally with an image forming structure having an image holder that holds the developer image, and each of the plurality of developer image forming parts having only one image holder.

* * * * *

UNITED STATES PATENT AND TRADEMARK OFFICE

CERTIFICATE OF CORRECTION

PATENT NO. : 8,295,730 B2
APPLICATION NO. : 12/617157
DATED : October 23, 2012
INVENTOR(S) : Kazuaki Iikura It is certified that error appears in the above-identified patent and that said Letters Patent is hereby corrected as shown below:

Delete the title page and substitute therefore the attached title page showing the corrected number of drawing sheets in patent.

Delete Drawing Sheets 1-9 and substitute therefore the attached Drawing Sheets 1-10. FIG. 3 has been added.

Signed and Sealed this
Twenty-sixth Day of February, 2013

Teresa Stanek Rea
*Acting Director of the United States Patent and Trademark Office*

(12) United States Patent
Iikura

(10) Patent No.: US 8,295,730 B2
(45) Date of Patent: Oct. 23, 2012

(54) IMAGE FORMING APPARATUS HAVING AN IMAGE FORMING PART AND A DETACHABLE DEVELOPER RECOVERY CONTAINER

(75) Inventor: Kazuaki Iikura, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 433 days.

(21) Appl. No.: 12/617,157

(22) Filed: Nov. 12, 2009

(65) Prior Publication Data

US 2010/0215398 A1 Aug. 26, 2010

(30) Foreign Application Priority Data

Feb. 20, 2009 (JP) ..... 2009-037514

(51) Int. Cl.
*G03G 21/18* (2006.01)

(52) U.S. Cl. ..... 399/111

(58) Field of Classification Search ..... 399/111, 399/113, 120, 257, 358, 360
See application file for complete search history.

(56) References Cited

U.S. PATENT DOCUMENTS

| | | | | |
|---|---|---|---|---|
| 7,155,148 | B2 * | 12/2006 | Nishimura et al. | 399/257 |
| 7,995,955 | B2 * | 8/2011 | Izumi et al. | 399/257 |
| 8,000,628 | B2 * | 8/2011 | Sato et al. | 399/360 |
| 8,116,662 | B2 * | 2/2012 | Ohta | 399/120 |

FOREIGN PATENT DOCUMENTS

| | | |
|---|---|---|
| JP | 11-003015 | 1/1999 |
| JP | 2000-321872 | 11/2000 |
| JP | 2004-198789 | 7/2004 |
| JP | 2006-195492 | 7/2006 |
| JP | 2007-102065 | 4/2007 |
| JP | 2008-134381 | 6/2008 |

* cited by examiner

*Primary Examiner* · William J Royer
(74) *Attorney, Agent, or Firm* — Morgan, Lewis & Bockius LLP

(57) ABSTRACT

An image forming apparatus includes: an image forming apparatus main body; plural developer image forming parts provided in the image forming apparatus main body that form a developer image; and a discharged developer recovery container that recovers developer discharged from at least two of the plural developer image forming parts. At least one of the plural developer image forming parts has an image forming structure having an image holder that holds the developer image, and the image forming structure in the at least one developer image forming part and the discharged developer recovery container are attached/removed, integrally with each other, in/from the image forming apparatus main body.

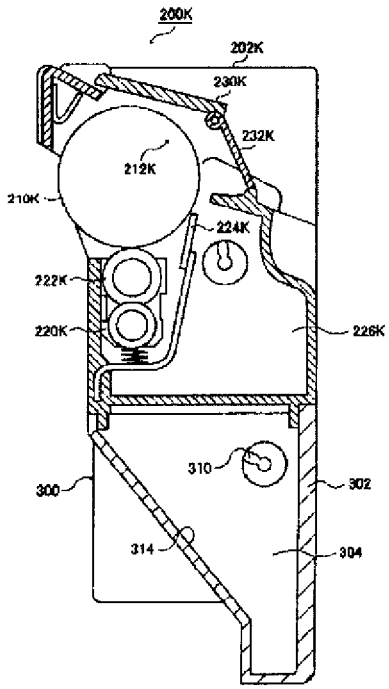

13 Claims, 10 Drawing Sheets